United States Patent [19]

Enriquez

[11] Patent Number: 4,827,862

[45] Date of Patent: May 9, 1989

[54] AERODYNAMIC CONTROL SYSTEM FOR HIGH SPEED MOTORBOATS

[76] Inventor: Enrique J. Enriquez, 3996 W. 8th La., Hialeah, Fla. 33012

[21] Appl. No.: 78,128

[22] Filed: Jul. 27, 1987

[51] Int. Cl.[4] ..... B63B 1/32

[52] U.S. Cl. ..... 114/273; 114/272

[58] Field of Search ..... 114/272, 273, 332, 150, 114/152, 163; 244/87

[56] References Cited

U.S. PATENT DOCUMENTS

| | | | |
|---|---|---|---|
| 1,401,934 | 12/1921 | Zahm | 244/87 |
| 1,747,565 | 2/1930 | Yonkese | 244/87 |
| 2,215,919 | 9/1940 | Finley | 114/272 |
| 2,354,453 | 7/1944 | Gazda | 114/272 |
| 2,849,978 | 9/1958 | Durham | 114/163 |
| 3,096,952 | 7/1963 | Roppel | 244/87 |
| 3,271,954 | 9/1966 | Marsee et al. | 114/150 |
| 3,903,832 | 9/1975 | Ishida | 114/273 |
| 4,095,549 | 6/1978 | Williams | 114/273 |
| 4,237,811 | 12/1980 | Montez | 114/273 |
| 4,685,641 | 8/1987 | Kirsch et al. | 114/272 |

*Primary Examiner*—Sherman D. Basinger
*Assistant Examiner*—Thomas J. Brahan
*Attorney, Agent, or Firm*—Allegretti & Witcoff, Ltd.

[57] ABSTRACT

In one embodiment, the aerodynamic control system includes a pair of airfoil shaped vertical stabilizing structures rising above the aft deck portion of the motorboat. A vertical stabilizer is disposed on either side of the deck. Each vertical stabilizer includes a movable rudder along its aft region which arcuately moves about an axis longitudinally extending through the rudder. The control system also includes an airfoil shaped elevator structure having end portions fixed to inboard opposing top sections of the vertical stabilizers and an arcuately movable elevator portion extending between the fixed first and second ends. A control mechanism arcuately moves the elevator portion thereby altering the angle of attack attitude of the elevator. Another control mechanism synchronously moves the rudders to assist steerage of the motorboat.

2 Claims, 2 Drawing Sheets

AERODYNAMIC CONTROL SYSTEM FOR HIGH SPEED MOTORBOATS

BACKGROUND OF THE INVENTION

The present invention relates to an aerodynamic control system for high speed motorboats and particularly relates to an aerodynamic system for boats that travel generally in excess of 50 miles per hour.

It is known that some of these high speed boats use neutral or fixed aerodynamic stabilizers to achieve an optimum operating condition when traveling at high speeds. As used herein, the term "high speed" refers to boats traveling at or in excess of 50 miles per hour. These neutral aerodynamic systems some times include two vertical rudder structures rising above the aft deck section of the boat at the port and starboard side. The neutral systems may also include a fixed elevator structure extending between the upper inboard portions of the vertical stabilizers. These neutral structures cannot be moved and hence cannot be adjusted for different operating conditions.

OBJECTS OF THE INVENTION

It is an object of the present invention to provide an aerodynamic control system for high speed motorboats that generates left or right lift forces to assist the steering.

It is a further object of the present invention to provide an aerodynamic control system which generates vertical lift to help the vessel plane better and optimize its performance.

It is an additional object of the present invention to provide such lift in controllable stages.

SUMMARY OF THE INVENTION

In one embodiment, the aerodynamic control system includes a pair of airoil shaped vertical stabilizing structures rising above the aft deck portion of the motorboat. A vertical stabilizer is disposed on either side of the deck. Each vertical stabilizer includes a movable rudder along its aft region which arcuately moves about an axis longitudinally extending through the rudder. The control system also includes an airfoil shaped elevator structure having end portions fixed to inboard opposing top sections of the vertical stabilizers and an arcuately movable elevator portion extending between the fixed first and second ends. A control mechanism arcuately moves the elevator portion thereby altering the angle of attack attitude of the elevator. Another control mechanism synchronously moves the rudders to assist steerage of the motorboat.

BRIEF DESCRIPTION OF THE DRAWINGS

Further objects and advantages of the present invention can be found in the detailed description of the preferred embodiment when taken in conjunction with the accompaying drawings in which.

DETAILED DESCRIPTION OF THE PREFERRED EMBODIMENT

The present invention relates to an aerodynamic control system for high speed boats.

Figure 1:
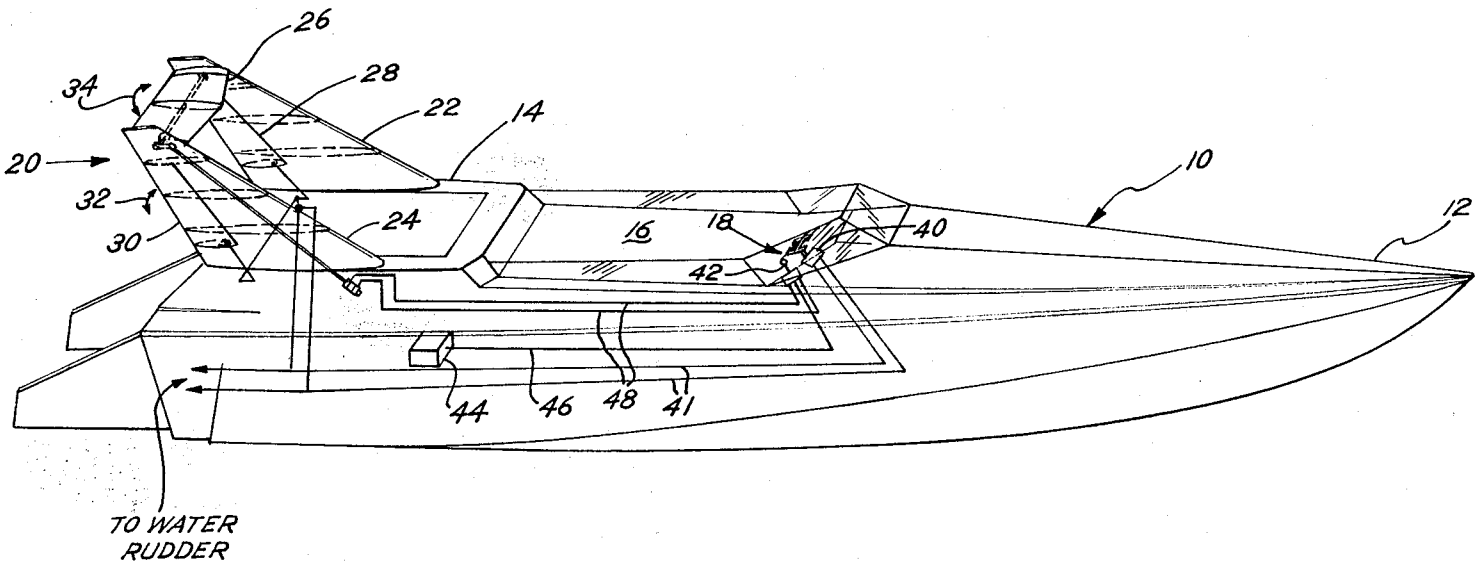
FIG. 1 diagrammatically illustrates a high speed motorboat with the aerodynamic control system; and, FIG. 2 diagrammatically illustrates a detail of the aerodynamic control system.
Figure 2:
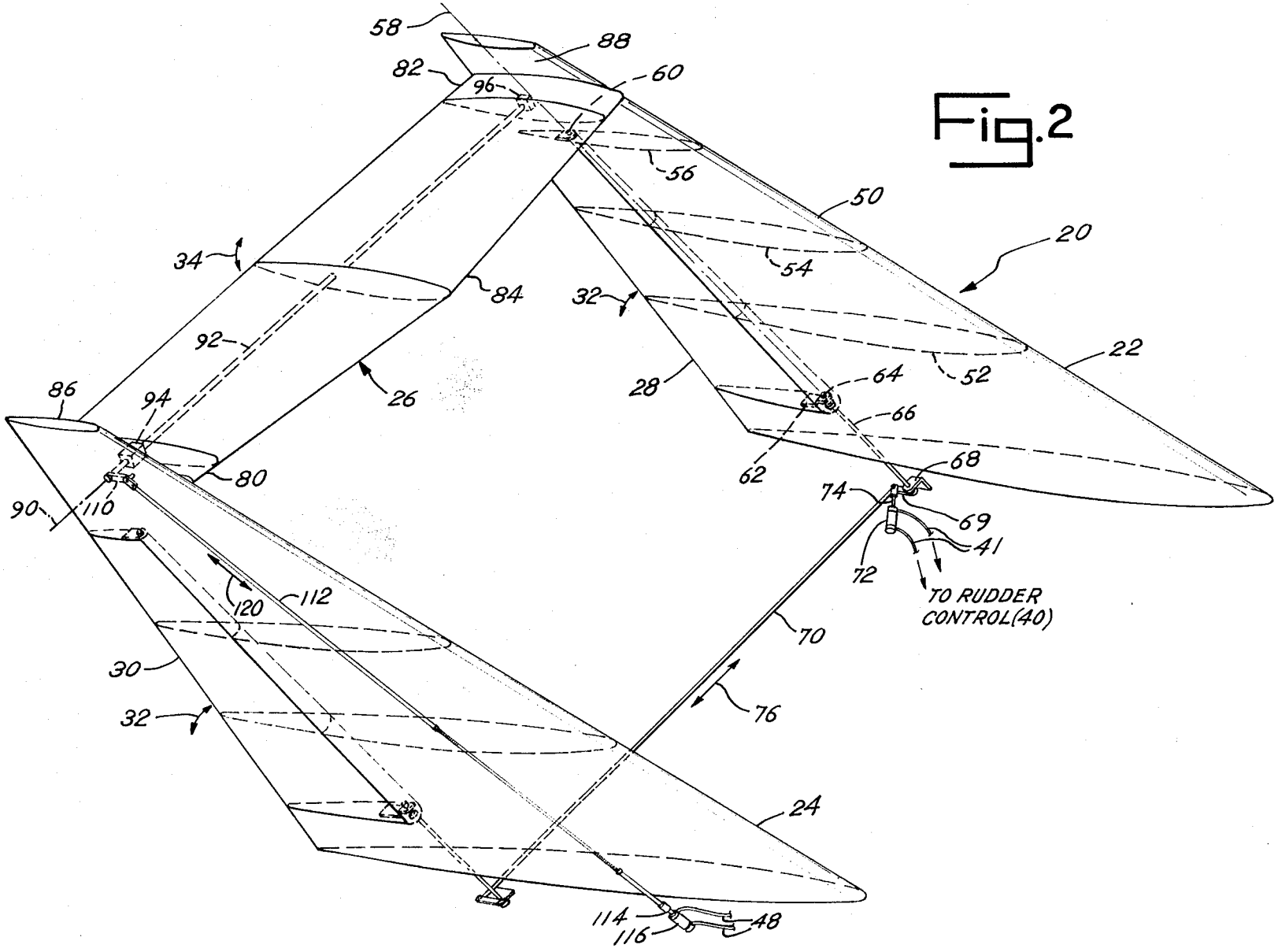

FIGS. 1 and 2 diagrammatically illustrate such a high speed motorboat with the aerodynamic control system and details of the aerodynamic control system, respectively. Similar numerals designate similar items throughout all the figures.

In FIG. 1, high speed motorboat 10 has a high speed planing mono hull with a bow deck portion 12 and an aft deck portion 14. Cockpit 16 is intermediate bow and aft decks 12 and 14. Control console 18 is disposed in cockpit 16.

Rising above aft deck portion 14 is the aerodynamic control system 20. Control system 20 includes two vertical stabilizer structures 22 and 24 and an elevator structure 26. Vertical stabilizers 22 and 24 and elevator 26 are airfoil shaped as noted by the cross-sectional contour lines shown in FIGS. 1 and 2. Vertical stabilizers 22 and 24 include, along their aft regions, arcuately movable rudders 28 and 30 respectively. These rudders move in an arc either left or right (port to starboard) as shown by double headed arrow 32. Elevator 26 includes an elevator portion that is movable in an arc in each of two opposite directions from a substantially horizontal position as generally shown by double headed arrow 34. These features will be described in detail with respect to FIG. 2.

Rudders 28 and 30 are simultaneously moved via a hydraulic control and a mechanical linkage that is coupled to steering console 40 disposed at control console 18. Control lines 41 are coupled to the hydraulic control for rudders 28 and 30 and to the water rudder for steering of high speed boat 10.

The angle of attack of moving portion of elevator 26 is also controlled by a mechanical linkage and hydraulic control. A three position, four way control mechanism (e.g., valve) is included in elevator control 42. The control may be a linear control joy stick. A hydraulic supply 44 is coupled to elevator control mechanism 42 via hydraulic supply line 46. The output of elevator control 42 is placed on hydraulic control lines 48 that is linked to the hydraulic actuator for the elevator control. The hydraulic and mechanical controls for the rudders and the movable elevator is dicussed later with respect to FIG. 2.

In operation, when motorboat 10 reaches approximately 50 miles per hour or higher, air flow over vertical stabilizers 22 and 24 acts to maintain straight ahead movement of boat 10. In the event boat 10 must turn, steering mechanism 40 controls the water rudder simultaneously with the hydraulic control of rudders 28 and 30. Rudders 28 and 30 generate left or right (port or starboard) lift to assist the steerage of the motorboat.

Elevator structure 26 is disposed above the turbulent air flow caused by air passing over the deck and cockpit of the boat. Preferably, elevator structure 26 is at a height at least two and most preferably 2½ feet above the turbulent air flow. At speeds of 50 miles per hour or higher, air flowing over the movable section of elevator 26 generates lift. By controlling the angle of attack of elevator 26, a vertical lift force is obtained which raises or lowers the aft portion of boat 10. By raising or lowering the aft portion of the boat, the boat planes the water better and an optimum level of performance of the boat is obtained. Elevator control 42 controls elevator 26 by generating hydraulic signals thereby controlling the speed of movement of elevator 26 and also the positioning of the elevator and the angle of attack attitude of the elevator.

FIG. 2 diagrammatically shows aerodynamic control system 20 in greater detail. Vertical stabilizers 22 and 24 are substantially the same therefore only one stabilizers will be discussed in detail. Vertical stabilizers 22 is a composite structure that includes a fixed stabilizer portion 50 and a movable rudder 28. The cross-sectional aspect of the composite vertical stabilizer 22 is completely airfoil shaped as noted by cross-sectional contour lines 52, 54 and 56.

Rudder 28 arcuately mvoes about axis 58 that longitudinally extends through the rudder. Rudder 28 rotates with respect to stationary vertical stabilizer portion 50 by pin 60 protruding upwards from the rudder into an appropriate bracket in fixed portion 50. Rudder 28 includes at its bottom a bracket 62 that is keyed to a terminal end 64 of pivot rod 66. Pivot rod 66 is journaled to stationary vertical stabilizer portion 50. The other terminal end of pivot rod 66 extends through bracket 68 and is attached to arm 69. A translating and horizontal bar 70 is attached to the distal end of arm 69 and is double acting hydraulic cylinder 72. Hydraulic cylinder 72 is attached to the boat. Therefore, when an appropriate control signal is applied to control lines 41 from rudder control 40, piston arm 74 of hydraulic cylinder 72 moves thereby causing rotation of pivot rod 66 and arcuate movement of rudder 28 due to the keyed arrangement between bracket 62 and terminal end 64 of pivot rod 66. Simultaneously, translating bar 70 moves in one of two specified directions shown by double headed arrows 76, thereby causing rudder 30 of the other vertical stabilizer 24 to simultaneously move.

Elevator 26 includes fixed elevator end portions 80 and 82 and a movable elevator portion 84 extending therebetween. Fixed ends 80 and 82 are mounted on the top, inboard, surfaces 86 and 88 of vertical stabilizing structures 24 and 22 respectively. Movable elevator 84 moves with respect to end portions 80 and 82 as well as with respect to other components of control system 20 and the boat. The entire elevator structure 26, that includes movable elevator 84 and fixed ends 80 and 82, is airfoil shaped. Movable elevator 84 arcuately moves about axis 90 that longitudinally extends through the elevator. A horizontal rod 92 is coaxial with this axis and is mounted in ball bearing boxes 94 and 96 respectively disposed in fixed end portions 80 and 82. Movable elevator 84 is fixed to intermediate sections of horizontal rod 92 at various locations such that when rod 92 rotates, movable elevator 84 rotates to the same degree. This can be achieved by having rod 92 keyed to strut sections of the elevator or having arms attached to rod 92 and similarly attached to movable elevator 84. These attachments are not shown in FIG. 2 but are readily recognized by persons of ordinary skill in the art.

Rod 92 is rotated via a mechanical and hydraulic system that includes arm 110 and vertical rod 112, both of which are disposed in the interior of vertical stabilizer 24. One end of arm 110 is attached to rod 92 and the other end of arm 110 is movably coupled to vertical rod 112. The other end of rod 112 is connected to piston arm 114 of hydraulic cylinder 116. Hydraulic cylinder 116 is controlled by a signal supplied through hydraulic supply lines 48 from hydraulic system and control stick 42 shown in FIG. 1 and described in detail in connection therewith. When vertical rod 112 moves in one of two opposite directions indicated by double headed arrow 120, arm 110 arcuately moves about axis 90 thereby rotating horizontal rod 92 and changing the angle of attack or attitude of movable elevator 84.

The claims appended hereto are meant to cover modifications and changes within the scope and spirit of the present invention. For example, the control system to move the rudders and the movable elevator could be a simple mechanical linkage or could be electromechanical or could entail further hydraulics that are not explicitly discussed herein. The claims appended hereto are meant to cover these and other changes.

What I claimed is:

1. An aerodynamic control system for high speed motor boats having a high speed planing mono hull with a bow deck portion and an aft deck portion comprising (a) a pair of airfoil shaped vertical stabilizers extending upwardly from said aft deck disposed in spaced substantially parallel relation to one another and secured at their bottoms to said aft deck on opposed sides thereof;

(b) each of said stabilizers having an air rudder mounted for arcuate movement about a vertical shaft spaced forwardly from the aft edge of the rudder, said air rudders being interconnected for synchronous turning;

(c) a pair of water rudders interconnected for synchronous turning;

(d) control means mounted on said hull connecting to said air rudders and to said water rudders for simultaneous operation thereof to steer the boat at high speeds;

(e) an airfoil shaped elevator extending between the upper ends of said spaced stabilizers and mounted for arcuate movement on rod having opposed ends in bearings fixed to said stabilizers; and (f) control means connecting to said elevator to tilt said elevator about said rod.

2. A control system as claimed in claim 1, wherein said elevator structure is disposed at least 2 feet above turbulent air flow caused by said deck during high speed operation of the boat.

* * * * *